US010586508B2

(12) United States Patent
Dunn

(10) Patent No.: US 10,586,508 B2
(45) Date of Patent: Mar. 10, 2020

(54) CONTROLLING DISPLAY BRIGHTNESS BASED ON IMAGE CAPTURE DEVICE DATA

(71) Applicant: Manufacturing Resources International, Inc., Alpharetta, GA (US)

(72) Inventor: William Dunn, Alpharetta, GA (US)

(73) Assignee: Manufacturing Resources International, Inc., Alpharetta, GA (US)

( * ) Notice: Subject to any disclaimer, the term of this patent is extended or adjusted under 35 U.S.C. 154(b) by 0 days.

(21) Appl. No.: 15/644,707

(22) Filed: Jul. 7, 2017

(65) Prior Publication Data

US 2018/0012565 A1 Jan. 11, 2018

Related U.S. Application Data

(60) Provisional application No. 62/360,117, filed on Jul. 8, 2016.

(51) Int. Cl.
*G09G 5/10* (2006.01)
*G09G 3/34* (2006.01)

(52) U.S. Cl.
CPC ..... *G09G 5/10* (2013.01); *G09G 3/3406* (2013.01); *G09G 2320/0285* (2013.01);
(Continued)

(58) Field of Classification Search
CPC ..... G09G 3/2096; G09G 3/2003; G09G 5/30; G09G 2320/0238; G09G 2320/08;
(Continued)

(56) References Cited

U.S. PATENT DOCUMENTS 4,093,355 A 6/1978 Kaplit et al.
4,593,978 A 6/1986 Mourey et al.
(Continued)

FOREIGN PATENT DOCUMENTS

EP 0313331 B1 2/1994
EP 2299723 A1 3/2011
(Continued)

OTHER PUBLICATIONS

Kunkely, H. et al., Photochemistry and Beer, Journal of Chemical Education, Jan. 1982, pp. 25-27, vol. 59, No. 1.
(Continued)

*Primary Examiner* — Md Saiful A Siddiqui
(74) *Attorney, Agent, or Firm* — Standley Law Group LLP; Jeffrey S. Standley; Eric M. Gayan

(57) ABSTRACT

A system and method for controlling the brightness level of an electronic display. An image capture device in proximity to the electronic display is used to capture images and/or video of the ambient environmental conditions local to the electronic display. The images and/or video is analyzed to determine the nature of the environmental conditions, and adjustments to the brightness level of the electronic display are made in consideration of said environmental conditions. In some embodiments, the images and/or video captured by the image capture device may be compared to stored images representative of different environmental conditions.

10 Claims, 12 Drawing Sheets

(52) U.S. Cl.
CPC ..... *G09G 2320/064* (2013.01); *G09G 2320/0693* (2013.01); *G09G 2330/021* (2013.01); *G09G 2356/00* (2013.01); *G09G 2360/144* (2013.01); *G09G 2360/16* (2013.01)

(58) Field of Classification Search
CPC ..... G09G 2320/0673; G09G 2360/16; G09G 2310/08; G09G 2320/064; G01S 19/14
See application file for complete search history.

(56) References Cited

U.S. PATENT DOCUMENTS 4,634,225 A 1/1987 Haim et al.
5,029,982 A 7/1991 Nash
5,086,314 A 2/1992 Aoki et al.
5,088,806 A 2/1992 McCartney et al.
5,162,785 A 11/1992 Fagard
5,247,374 A 9/1993 Terada
5,559,614 A 9/1996 Urbish et al.
5,661,374 A 8/1997 Cassidy et al.
5,748,269 A 5/1998 Harris et al.
5,767,489 A 6/1998 Ferrier
5,783,909 A 7/1998 Hochstein
5,786,801 A 7/1998 Ichise
5,808,418 A 9/1998 Pitman et al.
5,818,010 A 10/1998 McCann
5,952,992 A 9/1999 Helms
5,991,153 A 11/1999 Heady et al.
6,085,152 A * 7/2000 Doerfel ..... G01S 7/003 702/3
6,089,751 A 7/2000 Conover et al.
6,144,359 A 11/2000 Grave
6,153,985 A 11/2000 Grossman
6,157,143 A 12/2000 Bigio et al.
6,157,432 A 12/2000 Helbing
6,181,070 B1 1/2001 Dunn et al.
6,191,839 B1 2/2001 Briley et al.
6,259,492 B1 7/2001 Imoto et al.
6,292,228 B1 9/2001 Cho
6,297,859 B1 10/2001 George
6,380,853 B1 4/2002 Long et al.
6,388,388 B1 5/2002 Weindorf et al.
6,400,101 B1 6/2002 Biebl et al.
6,417,900 B1 7/2002 Shin et al.
6,509,911 B1 1/2003 Shimotono
6,535,266 B1 3/2003 Nemeth et al.
6,556,258 B1 4/2003 Yoshida et al.
6,628,355 B1 9/2003 Takahara
6,701,143 B1 3/2004 Dukach et al.
6,712,046 B2 3/2004 Nakamichi
6,753,661 B2 6/2004 Muthu et al.
6,753,842 B1 6/2004 Williams et al.
6,762,741 B2 7/2004 Weindorf
6,798,341 B1 9/2004 Eckel et al.
6,809,718 B2 10/2004 Wei et al.
6,812,851 B1 11/2004 Dukach et al.
6,813,375 B2 11/2004 Armato, III et al.
6,839,104 B2 1/2005 Taniguchi et al.
6,850,209 B2 2/2005 Mankins et al.
6,885,412 B2 4/2005 Ohnishi et al.
6,886,942 B2 5/2005 Okada et al.
6,891,135 B2 5/2005 Pala et al.
6,943,768 B2 9/2005 Cavanaugh et al.
6,982,686 B2 1/2006 Miyachi et al.
6,996,460 B1 2/2006 Krahnstoever et al.
7,015,470 B2 3/2006 Faytlin et al.
7,038,186 B2 5/2006 De Brabander et al.
7,064,733 B2 6/2006 Cok et al.
7,083,285 B2 8/2006 Hsu et al.
7,136,076 B2 11/2006 Evanicky et al.
7,174,029 B2 2/2007 Agostinelli et al.
7,176,640 B2 2/2007 Tagawa
7,236,154 B1 6/2007 Kerr et al.
7,307,614 B2 12/2007 Vinn
7,324,080 B1 1/2008 Hu et al.
7,330,002 B2 2/2008 Joung
7,354,159 B2 4/2008 Nakamura et al.
7,474,294 B2 1/2009 Leo et al.
7,480,042 B1 1/2009 Phillips et al.
7,518,600 B2 4/2009 Lee
7,595,785 B2 9/2009 Jang
7,639,220 B2 12/2009 Yoshida et al.
7,659,676 B2 2/2010 Hwang
7,692,621 B2 4/2010 Song
7,724,247 B2 5/2010 Yamazaki et al.
7,795,574 B2 9/2010 Kennedy et al.
7,795,821 B2 9/2010 Jun
7,800,706 B2 9/2010 Kim et al.
7,804,477 B2 9/2010 Sawada et al.
7,982,706 B2 7/2011 Ichikawa et al.
8,087,787 B2 1/2012 Medin
8,111,371 B2 2/2012 Suminoe et al.
8,125,163 B2 2/2012 Dunn et al.
8,144,110 B2 3/2012 Huang
8,175,841 B2 5/2012 Ooghe
8,194,031 B2 6/2012 Yao et al.
8,248,203 B2 8/2012 Hanwright et al.
8,352,758 B2 1/2013 Atkins et al.
8,508,155 B2 8/2013 Schuch
8,569,910 B2 10/2013 Dunn et al.
8,605,121 B2 12/2013 Chu et al.
8,700,226 B2 4/2014 Schuch et al.
8,797,372 B2 8/2014 Liu
8,810,501 B2 8/2014 Budzelaar et al.
8,823,630 B2 9/2014 Roberts et al.
8,829,815 B2 9/2014 Dunn et al.
8,895,836 B2 11/2014 Amin et al.
8,901,825 B2 12/2014 Reed
8,982,013 B2 3/2015 Sako et al.
8,983,385 B2 3/2015 Macholz
8,988,011 B2 3/2015 Dunn
9,030,129 B2 5/2015 Dunn et al.
9,167,655 B2 10/2015 Dunn et al.
9,286,020 B2 3/2016 Dunn et al.
9,448,569 B2 9/2016 Schuch et al.
9,451,060 B1 9/2016 Bowers et al.
9,516,485 B1 12/2016 Bowers et al.
9,536,325 B2 1/2017 Bray et al.
9,622,392 B1 4/2017 Bowers et al.
9,924,583 B2 3/2018 Schuch et al.
2002/0009978 A1 1/2002 Dukach et al.
2002/0050974 A1 5/2002 Rai et al.
2002/0065046 A1 5/2002 Mankins et al.
2002/0084891 A1 7/2002 Mankins et al.
2002/0101553 A1 8/2002 Enomoto et al.
2002/0112026 A1 8/2002 Fridman et al.
2002/0126248 A1 9/2002 Yoshida
2002/0154138 A1 10/2002 Wada et al.
2002/0164962 A1 11/2002 Mankins et al.
2002/0167637 A1 11/2002 Burke et al.
2002/0190972 A1 12/2002 Ven de Van
2003/0007109 A1 1/2003 Park
2003/0088832 A1 5/2003 Agostinelli et al.
2003/0122810 A1* 7/2003 Tsirkel ..... G09G 3/20 345/207
2003/0204342 A1 10/2003 Law et al.
2003/0214242 A1 11/2003 Berg-johansen
2003/0230991 A1 12/2003 Muthu et al.
2004/0032382 A1 2/2004 Cok et al.
2004/0036622 A1 2/2004 Dukach et al.
2004/0036697 A1 2/2004 Kim et al.
2004/0036834 A1 2/2004 Ohnishi et al.
2004/0113044 A1 6/2004 Ishiguchi
2004/0165139 A1 8/2004 Anderson et al.
2004/0243940 A1 12/2004 Lee et al.
2005/0012734 A1 1/2005 Johnson et al.
2005/0043907 A1 2/2005 Eckel et al.
2005/0049729 A1 3/2005 Culbert et al.
2005/0073518 A1 4/2005 Bontempi
2005/0094391 A1 5/2005 Campbell et al.
2005/0127796 A1 6/2005 Olesen et al.
2005/0140640 A1 6/2005 Oh et al.
2005/0184983 A1 8/2005 Brabander et al.
2005/0231457 A1 10/2005 Yamamoto et al.

(56) References Cited

U.S. PATENT DOCUMENTS

2005/0242741 A1 11/2005 Shiota et al.
2006/0007107 A1 1/2006 Ferguson
2006/0022616 A1 2/2006 Furukawa et al.
2006/0038511 A1 2/2006 Tagawa
2006/0049533 A1 3/2006 Kamoshita
2006/0087521 A1 4/2006 Chu et al.
2006/0125773 A1 6/2006 Ichikawa et al.
2006/0130501 A1 6/2006 Singh et al.
2006/0197474 A1 9/2006 Olsen
2006/0197735 A1 9/2006 Vuong et al.
2006/0214904 A1 9/2006 Kimura et al.
2006/0215044 A1 9/2006 Masuda et al.
2006/0220571 A1 10/2006 Howell et al.
2006/0238531 A1 10/2006 Wang
2006/0244702 A1 11/2006 Yamazaki et al.
2007/0013828 A1 1/2007 Cho et al.
2007/0047808 A1 3/2007 Choe et al.
2007/0152949 A1 7/2007 Sakai
2007/0171647 A1 7/2007 Artwohl et al.
2007/0173297 A1 7/2007 Cho et al.
2007/0200513 A1 8/2007 Ha et al.
2007/0222730 A1 9/2007 Kao et al.
2007/0230167 A1 10/2007 McMahon et al.
2007/0247594 A1 10/2007 Tanaka
2007/0268234 A1 11/2007 Wakabayashi et al.
2007/0268241 A1 11/2007 Nitta et al.
2007/0273624 A1 11/2007 Geelen
2007/0279369 A1 12/2007 Yao et al.
2007/0291198 A1 12/2007 Shen
2007/0297163 A1 12/2007 Kim et al.
2007/0297172 A1 12/2007 Furukawa et al.
2008/0019147 A1 1/2008 Erchak et al.
2008/0055297 A1 3/2008 Park
2008/0074382 A1 3/2008 Lee et al.
2008/0078921 A1 4/2008 Yang et al.
2008/0084166 A1 4/2008 Tsai
2008/0111958 A1 5/2008 Kleverman et al.
2008/0136770 A1 6/2008 Peker et al.
2008/0143187 A1 6/2008 Hoekstra et al.
2008/0151082 A1 6/2008 Chan
2008/0176345 A1 7/2008 Yu et al.
2008/0185976 A1 8/2008 Dickey et al.
2008/0204375 A1 8/2008 Shin et al.
2008/0218501 A1 9/2008 Diamond
2008/0246871 A1 10/2008 Kupper et al.
2008/0266554 A1 10/2008 Sekine et al.
2008/0278099 A1 11/2008 Bergfors et al.
2008/0278100 A1 11/2008 Hwang
2008/0303918 A1 12/2008 Keithley
2009/0009997 A1 1/2009 Sanfilippo et al.
2009/0033612 A1 2/2009 Roberts et al.
2009/0079416 A1 3/2009 Vinden et al.
2009/0085859 A1 4/2009 Song
2009/0091634 A1 4/2009 Kennedy et al.
2009/0104989 A1 4/2009 Williams et al.
2009/0109129 A1* 4/2009 Cheong ..... G09G 5/02 345/20
2009/0135167 A1 5/2009 Sakai et al.
2009/0152445 A1 6/2009 Gardner, Jr.
2009/0278766 A1 11/2009 Sake et al.
2009/0284457 A1 11/2009 Botzas et al.
2009/0289968 A1 11/2009 Yoshida
2010/0039414 A1* 2/2010 Bell ..... G09G 3/20 345/207
2010/0039440 A1 2/2010 Tanaka et al.
2010/0060861 A1 3/2010 Medin
2010/0177750 A1 7/2010 Essinger et al.
2010/0231602 A1* 9/2010 Huang ..... G09G 3/3406 345/589
2010/0253660 A1 10/2010 Hashimoto
2011/0032285 A1 2/2011 Yao et al.
2011/0050738 A1 3/2011 Fujioka et al.
2011/0058326 A1 3/2011 Idems et al.
2011/0074737 A1 3/2011 Hsieh et al.
2011/0074803 A1 3/2011 Kerofsky
2011/0102630 A1 5/2011 Rukes
2011/0163691 A1 7/2011 Dunn
2011/0175872 A1 7/2011 Chuang et al.
2011/0193872 A1 8/2011 Biernath et al.
2011/0231676 A1 9/2011 Atkins et al.
2011/0260534 A1 10/2011 Rozman et al.
2011/0279426 A1 11/2011 Imamura et al.
2012/0075362 A1 3/2012 Ichioka et al.
2012/0081279 A1 4/2012 Greenebaum et al.
2012/0176420 A1 7/2012 Liu
2012/0182278 A1 7/2012 Ballestad
2012/0212520 A1 8/2012 Matsui et al.
2012/0268436 A1 10/2012 Chang
2012/0284547 A1 11/2012 Culbert et al.
2013/0027370 A1 1/2013 Dunn et al.
2013/0098425 A1 4/2013 Amin et al.
2013/0113973 A1* 5/2013 Miao ..... G09G 3/003 348/333.01
2013/0158730 A1 6/2013 Yasuda et al.
2013/0278868 A1 10/2013 Dunn et al.
2014/0002747 A1 1/2014 Macholz
2014/0132796 A1* 5/2014 Prentice ..... G03B 7/08 348/223.1
2014/0139116 A1 5/2014 Reed
2014/0204452 A1 7/2014 Branson
2014/0232709 A1 8/2014 Dunn et al.
2014/0285477 A1 9/2014 Cho et al.
2014/0365965 A1 12/2014 Bray et al.
2015/0062892 A1 3/2015 Krames et al.
2015/0070337 A1* 3/2015 Bell ..... G09G 3/2003 345/207
2015/0310313 A1* 10/2015 Murayama ..... G01C 21/3602 382/104
2015/0346525 A1 12/2015 Wolf et al.
2015/0348460 A1* 12/2015 Cox ..... G06F 3/14 345/690
2016/0037606 A1 4/2016 Dunn et al.
2016/0198545 A1 7/2016 Dunn et al.
2016/0334811 A1* 11/2016 Marten ..... G05B 15/02
2016/0338181 A1 11/2016 Schuch et al.
2016/0338182 A1 11/2016 Schuch et al.
2016/0358530 A1 12/2016 Schuch et al.
2016/0358538 A1 12/2016 Schuch et al.
2017/0111486 A1 4/2017 Bowers et al.
2017/0111520 A1 4/2017 Bowers et al.
2017/0168295 A1* 6/2017 Iwami ..... G02B 27/017
2018/0040297 A1 2/2018 Dunn et al.
2018/0042134 A1 2/2018 Dunn et al.

FOREIGN PATENT DOCUMENTS

EP 2401738 A2 1/2012
EP 2577389 A2 4/2013
EP 2769376 A1 8/2014
GB 2369730 A 5/2002
JP 3-153212 A 7/1991
JP 8193727 A 7/1996
JP 11-160727 A 6/1999
JP 2000122575 A 4/2000
JP 2004325629 A 11/2004
JP 2005265922 A 9/2005
JP 2006-145890 A 6/2006
JP 2006318733 A 11/2006
JP 2007003638 A 1/2007
JP 2007322718 A 12/2007
JP 2008-34841 A 2/2008
JP 2008122695 A 5/2008
JP 2009031622 A 2/2009
JP 2010282109 A 12/2010
KR 10-2006-0016469 A 2/2006
KR 10-2008-0000144 A 1/2008
KR 10-2008-0013592 A 2/2008
KR 10-2008-0086245 A 9/2008
KR 10-2011-0125249 A 11/2011
KR 10-1759265 B1 7/2017
WO 2008050402 A1 5/2008
WO 2010141739 A2 12/2010
WO 2011052331 A1 5/2011

(56) References Cited

FOREIGN PATENT DOCUMENTS

| | | | |
|---|---|---|---|
| WO | WO2011130461 | A2 | 10/2011 |
| WO | 2011150078 | A2 | 12/2011 |
| WO | 2013/044245 | A1 | 3/2013 |
| WO | 2016183576 | A1 | 11/2016 |
| WO | 2017031237 | A1 | 2/2017 |
| WO | 2017210317 | A1 | 12/2017 |

OTHER PUBLICATIONS

Novitsky, T. et al., Design How-to, Driving LEDs versus CCFLs for LCD backlighting, EE Times, Nov. 12, 2007, 6 pages, AspenCore.
Zeef, Hubing, EMC analysis of 18' LCD Monitor, Aug. 2000, 1 page.

* cited by examiner

| TIME OF DAY | HISTOGRAM ANALYSIS OF PICTURE MINIMUM | HISTOGRAM ANALYSIS OF PICTURE MAXIMUM | DESIRED DISPLAY LUMINANCE |
|---|---|---|---|
| 7:00AM | 0 | 150 | 1000 |
| | 151 | 500 | 1500 |
| | 501 | 1000 | 2000 |
| 12:00PM | 0 | 150 | 1500 |
| | 151 | 500 | 2000 |
| | 501 | 1000 | 2500 |
| 5:00PM | 0 | 150 | 1200 |
| | 151 | 500 | 1700 |
| | 501 | 1000 | 2200 |

| ENVIRONMENTAL CONDITIONS | DESIRED DISPLAY LUMINANCE |
|---|---|
| CLEAR WITH LITTLE SUNLIGHT | 1400 |
| CLEAR WITH MODERATE SUNLIGHT | 1700 |
| CLEAR WITH BRIGHT SUNLIGHT | 2000 |
| RAIN | 1700 |
| FOG | 1500 |
| SNOW | 1900 |
| SLEET | 1700 |
| HAIL | 1700 |
| 25% CLOUDCOVER | 2000 |
| 50% CLOUDCOVER | 1800 |
| 75% CLOUDCOVER | 1600 |
| 100% CLOUDCOVER | 1400 |
| NIGHTTIME | 1100 |

CONTROLLING DISPLAY BRIGHTNESS BASED ON IMAGE CAPTURE DEVICE DATA

TECHNICAL FIELD

Exemplary embodiments described and shown herein generally relate to a system and method for controlling the brightness of an electronic display based on various metrics.

BACKGROUND

Electronic displays, once used primarily for only indoor entertainment purposes, are now also being utilized for indoor and outdoor advertising/informational purposes. For example, various types of flat panel electronic displays are now being used to present information and advertising materials to consumers in locations outside of their own home, such as within airports, arenas, stadiums, and restaurants/bars, at gas station pumps, on billboards, and even in shifting locations via mobile electronic displays on the tops of automobiles or on the sides of trucks.

The rapid development of flat panel electronic displays has allowed users to mount such displays in a variety of locations that were not previously possible. Further, the popularity of high-definition (HD) television has increased the demand for larger and brighter displays, especially large displays that are capable of producing HD video. The highly competitive field of consumer advertising has also increased the demand for large displays that are located outdoors and sometimes exposed to direct sunlight or other high ambient light conditions (e.g., light from street lights, building signs, vehicle headlights, and other displays). In order to be effective, outdoor displays must compete with the ambient natural light to provide a clear and bright image to a viewer.

SUMMARY OF THE GENERAL INVENTIVE CONCEPT

The various exemplary embodiments described and shown herein are directed to a system and method for controlling the luminance of an electronic display based on a combination of metrics. Exemplary systems and methods are configured to appropriately illuminate an electronic display based on local ambient conditions to maximize visibility while optimizing power usage. For example, in order to conserve electrical energy, a given electronic display may be driven at a higher brightness level under bright ambient conditions to maximize visibility, and may be driven at a lower brightness level under dim ambient conditions.

In some embodiments, control of the brightness level may be based on the time of day, which is compared with sunrise/sunset data associated with the geographic location of the display. Generally speaking, an ambient light sensor is not necessary. In such exemplary embodiments, the system may include a location detection device, such as but not limited to a Global Positioning System (GPS) device, that determines the geographic location of the display. Sunset and sunrise transition periods may be calculated by the system based on the location of the display and may be used to gradually adjust the display brightness up/down during these transition periods.

In some other exemplary embodiments, electronic display brightness control may employ a camera that is positioned in close proximity to the display and is configured to periodically capture a still image or video of the weather conditions to which the display is exposed. A processor may be utilized to subsequently analyze the captured image or video data to determine the local weather conditions and, when necessary, to appropriately adjust the brightness of the electronic display. Further embodiments may also access local weather information and adjust the brightness level of an electronic display based on the percentage of cloud cover or other weather conditions. Weather conditions of interest to an exemplary system and method embodiment may include, but are not limited to, precipitation, fog, haze, and cloud, all of which can affect the ambient lighting conditions to which a given electronic display is exposed throughout the day (or night).

BRIEF DESCRIPTION OF THE DRAWINGS

In addition to the features mentioned above, other aspects of the inventive concept will be readily apparent from the following descriptions of the drawings and exemplary embodiments, wherein like reference numerals across the several views refer to identical or equivalent features, and wherein.

DETAILED DESCRIPTION OF EXEMPLARY EMBODIMENTS

Figure 1:
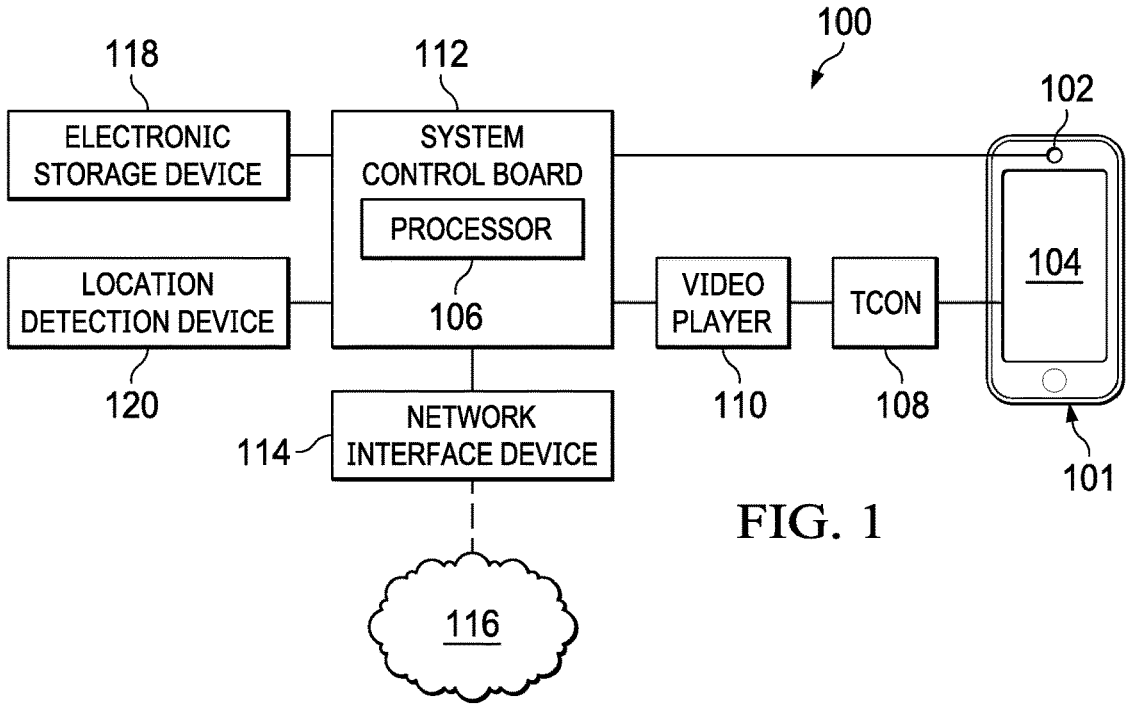
FIG. 1 is a simplified block diagram for an exemplary electronic display assembly.

Exemplary system and method embodiments are described more fully hereinafter with reference to the accompanying drawings, in which exemplary such embodiments are shown. The inventive concept may, however, be embodied in many different forms and should not be construed as limited to the exemplary embodiments set forth herein. Rather, these embodiments are provided so as to thoroughly convey the scope of the inventive concept to those skilled in the art. In the drawings, the size and relative sizes of layers and regions may be exaggerated for clarity.

The terminology used herein is for the purpose of describing exemplary embodiments only and is not intended to be limiting of the inventive concept. As used herein, the singular forms "a", "an" and "the" are intended to include the plural forms as well, unless the context clearly indicates otherwise. It will be further understood that the terms "comprises" and/or "comprising," when used in this specification, indicate the presence of stated features, integers, steps, operations, elements, and/or components, but do not preclude the presence or addition of one or more other features, integers, steps, operations, elements, components, and/or groups thereof.

Exemplary system and method embodiments are described herein with reference to illustrations that are schematic in nature and, as such, variations from the shapes of the illustrations as a result, for example, of manufacturing techniques and/or tolerances, are to be expected. Thus, embodiments of the inventive concept should not be construed as limited to the particular shapes of regions illustrated herein but are to include deviations in shapes.

Unless otherwise defined, all terms (including technical and scientific terms) used herein have the same meaning as commonly understood by one of ordinary skill in the art to which the inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Referring now to the drawings, FIG. 1 presents a block diagram of one exemplary electronic display assembly 100. The assembly 100 may include a housing 101 having a camera 102 and an electronic display 104 located near the camera. The camera 102 may be configured to take still images, video, or both. The electronic display 104 may be any type of electronic display 104 such as, but not limited to liquid crystal, plasma, light-emitting polymer, and organic light emitting diode (OLED) displays. The housing 101 may be any size or shape and may form a cabinet configured to house a variety of electronic devices described herein, including the electronic display 104.

A timing and control board (TCON) 108 may be electrically connected to the electronic display 104. A video player 110 may be electrically connected to the TCON 108 and to a system control board 112. The video player 110 and TCON 108 may be configured to display still or video images on the electronic display 104 as directed by the system control board 112. The images or videos may be stored on an electronic storage device 118. In some exemplary embodiments, the electronic storage device 118 may be local to the electronic display assembly 100. In other exemplary embodiments, the electronic storage device 118 may be a networked device that is located remotely from the electronic display assembly 100.

The system control board 112 may be configured to provide display setting instructions for the electronic display 104. The display settings may include, for example and without limitation, what images are to be displayed, in what order the images are to be displayed, the length of time the images are to be displayed, etc. The system control board 112 may additionally provide appearance setting instructions for the electronic display 104. The appearance settings may include, for example and without limitation, levels for brightness, color saturation, warmth, volume, contrast, etc. The appearance and display settings may be pre-programmed or may be altered at any time, such as by a remote user.

The camera 102 may be electrically connected or otherwise in communication with the system control board 112. A processor 106 of the system control board 112 may be provided with captured image and/or video data from the camera 102 and may be configured to perform an analysis on said data to determine the ambient weather conditions local to the electronic display 104. For example, the processor 106 may be programmed, or may operate in conjunction with software, to determine weather conditions by direct analysis of the images/video. The analysis performed by the processor 106 may be carried out using shape recognition, histogram analysis, motion detection, and other imaging processing and analysis techniques, software, and systems.

In some exemplary embodiments, a number of sample images of various weather conditions may be previously stored and made accessible by the processor 106. In such an embodiment, an image/video captured by the camera 102 may be compared to the sample images and/or sample video using, such as by employing image similarity analysis techniques, software, and systems. If a captured image/video has a sufficient level of similarity to a stored image/video of a particular weather condition, a predetermined adjustment may be made to the brightness or other settings of the electronic display 104 based on that weather condition. In other exemplary embodiments, the brightness or other settings of the electronic display 104 may be adjusted based on the percentage or level of similarity between a given captured image/video and the sample images/videos.

Whether a direct analysis of a captured image/video is performed, or a similarity analysis is performed between a captured image/video and stored images/videos of known weather conditions, an exemplary system and method embodiment is able to determine/identify a number of different weather conditions. Such weather conditions that are identifiable by the processor 106 may include, but are not limited to, rain, snow, hail, sleet, other precipitation, sunlight, cloud cover, cloud ceiling, fog, haze, large light-blocking objects, etc.

The processor 106 may be placed upon and in electrical connection with the system control board 112. Data pertaining to the results of the image analysis may be sent to the system control board 112 and the system control board may adjust the appearance settings of the electronic display 104 based on the image analysis. In exemplary embodiments, if the image analysis reveals weather conditions likely to result in dim ambient lighting conditions, such as but not limited to, rain, cloud cover, low cloud ceiling, snow, hail, sleet, other precipitation, fog, haze, or the like, the system control board 112 may direct the electronic display 104 to be driven at a higher brightness level. If, on the other hand, the image analysis reveals weather conditions likely to result in brighter ambient lighting conditions, such as but not limited to, sunshine, little cloud coverage, high cloud ceiling, and the like, the system control board 112 may direct the electronic display 104 to be driven at a lower brightness level. In some exemplary embodiments, the processor 106 may translate the image analysis into a weather factor number as described herein.

The system control board 112 may be electrically connected to a network interface device 114. The network interface device 114 may facilitate a connection with, and communication over, a communications network 116 such as, but not limited to, an intranet, the Internet, the world wide web, a cellular network, or the like. This connection may permit a remote user to alter the appearance settings and display settings, and to monitor the performance and operation of, the electronic display assembly 100.

The system control board 112 may additionally be electrically connected to a location detection device 120. In some exemplary embodiments, the location detection device 120 may be a GPS-enabled device. In other exemplary embodiments, the location detection device 120 may operate by the use of multilateration, trilateration, etc., of radio tower signals, such as but not limited to, cellular network towers, Wi-Fi routers, and the like. Those having ordinary skill in the art will recognize any location detection method may be utilized.

Figure 2:
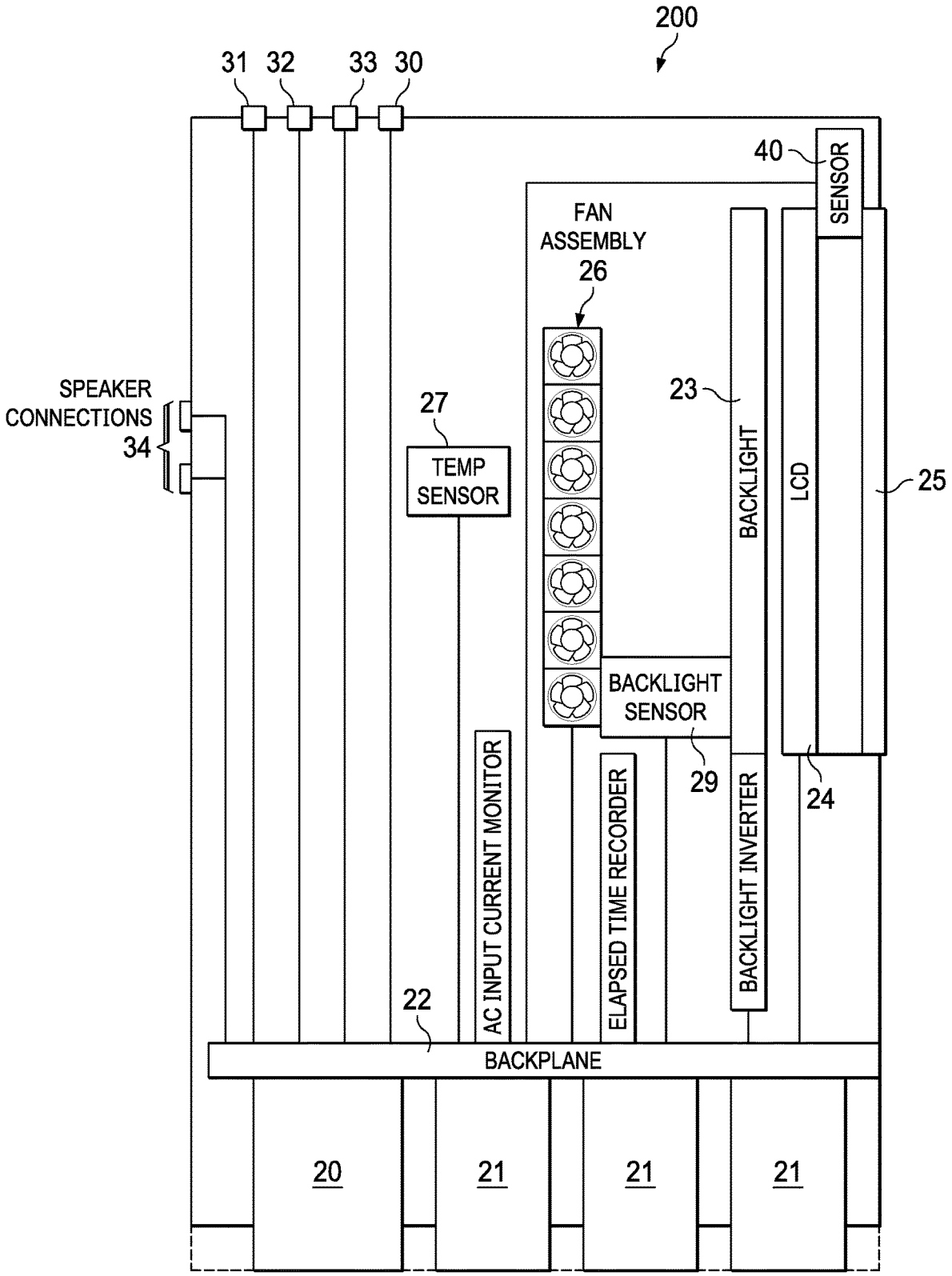
FIG. 2 is another block diagram illustrating various electronic components which may be used within an exemplary electronic display assembly.

FIG. 2 is a block diagram illustrating various electronic components that may be used within another exemplary embodiment of an electronic display assembly 200. In this exemplary embodiment, one or more power modules 21 may be electrically connected with a backplane 22, which could be provided as a printed circuit board that may facilitate electrical communication and/or power between a number of components of the display assembly. A display controlling assembly 20 may also be electrically connected with the backplane 22. The display controlling assembly 20 preferably includes a number of different components, including but not limited to the video player 110, electronic storage device 118, processor 106 and system control board 112 which are programmed to perform any of the logic that is described herein.

FIG. 2 also indicates that the exemplary electronic display assembly 200 includes a backlight 23, LCD assembly 24, and a front transparent display panel 25. The backlight 23 may be a CCFL or light emitting diode (LED) backlight. It should be noted that although the setup for an LCD is shown, embodiments can be practiced with any electronic image-producing assembly. Thus other flat panel displays could be used, such as without limitation, plasma, light-emitting polymer, and organic light emitting diode (OLED) displays. When the display type does not include a traditional backlight, then the term "backlight" can be replaced with "display" and the term "backlight level", can be replaced with "display level." A fan assembly 26 is also shown for optionally cooling displays that may reach elevated temperatures. One or more temperature sensors 27 may be used to monitor the temperature of the display assembly, and selectively engage fan assembly 26 when cooling is needed.

A variety of different electrical inputs/outputs are also shown in FIG. 2, and all or only a select few of the inputs/outputs may be practiced with any given embodiment. As shown here, an AC power input 30 delivers incoming power to the backplane 22. A video signal input 31 may be provided and may be configured to receive video signals from a plurality of different sources. In an exemplary embodiment, the video signal input 31 may be an HDMI input. Two data interface connections 32 and 33 are also shown to be a part of the exemplary electronic display assembly 200. One of the data interface connections may be a RS2332 port or an IEEE 802.3 jack that can facilitate user setup and system monitoring. Either form of the connection should allow electrical communication with a personal computer. The other data interface connection may be a network connection such as an Ethernet port, wireless network connection, a satellite network connection, or the like. This second data interface connection preferably allows the display assembly to communicate with the internet, and may also permit a remote user to communicate with the display assembly. The second data interface connection may also provide video data through a network source, and may be utilized to transmit display settings, error messages, and various other forms of data to a website for access and control by the user. Optional audio connections 34 may also be provided for connection to internal or external speaker assemblies. It is not required that the data inputs 31, 32, and 33 receive their data through a wired connection, as many embodiments may utilize wireless networks or satellite networks to transmit data to the display assembly. The various types of wireless/satellite receivers and transmitters have not been specifically shown due to the large number of variable types and arrangements, but such receivers and transmitters would be well understood by a person of ordinary skill in the art.

A backlight sensor 29 may be placed within the backlight cavity of the electronic display assembly 200 to measure the brightness level within the backlight cavity. Additionally, a display light sensor 40 may be positioned in front of the display 24 in order to measure the brightness level of the display 24. Either sensor can be used in a traditional feed-back loop to evaluate the control signals being sent to the power modules 21 and the resulting backlight brightness intensity or display brightness intensity generated in response.

Information for monitoring the status of the various display components may be transmitted through either of the two data interface connections 32 and 33, so that the user can be notified when a component may be functioning improperly, about to fail, or has already failed and requires replacement. The information for monitoring the status of the display may include, but is not limited to: power supply status, power supply test results, AC input current, temperature sensor readings, fan speed, video input status, firmware revision, and light level sensor readings. Also, the user may adjust settings including, but not limited to: on/off, brightness level, various alert settings, IP address, customer defined text/video, display matrix settings, display of image settings via OSD, and various software functions. In some embodiments, these settings can be monitored and altered from either of the two data interface connections 32 and 33.

Figure 3:
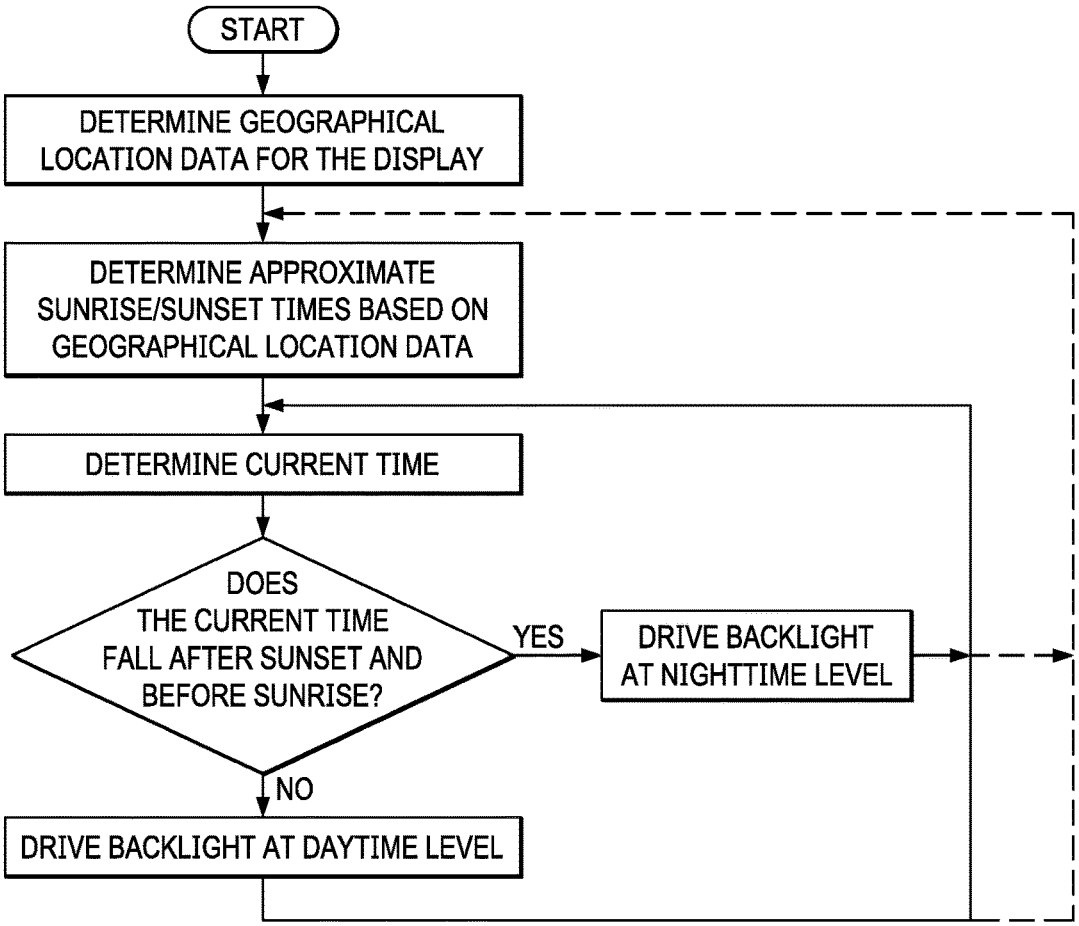
FIG. 3 is a logic flow chart for an exemplary method of controlling electronic display brightness based only on the display location.

FIG. 3 is a logic flow chart for an exemplary method of controlling electronic display brightness based only on the display location. As an initial step in this embodiment, the system preferably determines the geographical location of the electronic display. The geographical location may be determined in a number of ways. For example, the physical address of the electronic display may be used to determine the city/state in which the display is located. Alternatively, the latitude and longitude coordinates of the electronic display may be used instead of physical address of the display. This latter technique can be performed by accessing a number of online tools, including but not limited to www.latlong.net. In yet another alternative technique, the location of the electronic display can be determined by reading coordinates from a GPS capable smart device or other location detection device 120. If the coordinates result in a physical address, then the address can be converted to latitude and longitude coordinates, or vice versa, by the techniques noted above.

Once the location of the electronic display is determined, the sunset and sunrise times for this location are preferably determined. The timing for performing this step can vary. In some embodiments, determining the sunset and sunrise times could be performed only once, with 365 days of data being used for the display throughout the remainder of the display's lifetime. Alternatively, this step could be performed annually, monthly, weekly, or even daily. This step can also be performed in a number of ways. For example, when given a physical address, the system can determine the sunrise/sunset times based on the address and store the times, such as on the electronic storage of the display controlling assembly 20. Alternatively, when given latitude/longitude coordinates, the system can determine the sunrise/sunset times based on said coordinates and store the coordinates within the electronic storage of the display controlling assembly 20. The location data can be converted to sunrise/sunset times by accessing any number of online databases, including but not limited to: www.sunrisesunset.com, www.suncalc.net, and various NOAA online tools. Additionally, the latitude and longitude data can be used to calculate sunrise/sunset times based on the sunrise equation:

$$\cos \omega_o = \tan \phi \times \tan \delta \quad (1)$$

where:

$\omega_o$ is the hour angle at either sunrise (when negative value is taken) or sunset (when positive value is taken);

$\phi$ is the latitude of the observer on the Earth; and $\delta$ is the sun declination.

It should be noted that the steps of determining geographical location data for a display and determining approximate sunrise/sunset times based on the geographical location data, may be performed before the display is shipped to its actual location. In other embodiments, the display may be installed within its actual location prior to performing these steps.

Once the approximate sunrise/sunset times are determined (and preferably stored at the display or otherwise), the system then determines the current time and also whether it is currently night or day. Although the logic of FIG. 3 asks "does the current time fall after sunset and before sunrise," it should be realized that this step could also be performed by determining "does the current time fall after sunrise and before sunset", and the manner in which said step is performed makes no difference in any of the exemplary embodiments. In this first exemplary embodiment, if the system determines that it is currently nighttime, the backlight is driven at the nighttime level. Alternatively, if the system determines that it is daytime, the backlight is driven at the daytime level.

The relative daytime level and nighttime level for the backlight may be selected in this embodiment through a simple binary operation, using a first backlight brightness level value appropriate to nighttime operation and a second backlight brightness level value appropriate to nighttime operation. The system may then supply as much power as necessary to the backlight 23 in order to produce the desired brightness level value at the backlight sensor 29. The power levels may be adjusted using feedback from the backlight sensor 29 to ensure that the desired brightness level of the backlight 23 is maintained. Alternatively, the desired brightness level can be measured based on the brightness level of the display 24, as measured by the light sensor 40. The light sensor 40 can also provide feedback to the system to ensure that the proper amount of power is being sent to the backlight 23 so that adequate display brightness levels. In still other embodiments, the relative daytime brightness level and nighttime brightness level for the backlight may be preprogrammed based on known data or assumptions about the proper power level that is required to achieve the desired brightness level.

Note that the dashed lines in FIG. 3 indicate the option of the system returning to determine the approximate sunrise/sunset times, if practicing an embodiment where this data is updated annually, monthly, weekly, daily, etc.

It should also be noted that when driving the backlight of an electronic display (or an electronic display without a backlight) based on location data and/or time of day, an exemplary system does not have to choose one brightness level for daytime and one brightness level for nighttime (although some embodiments employ this method). Instead, an exemplary system may make slight adjustments to the brightness level based on the current time of day. For example, while 9:15 a.m. and 1:30 p.m. would each normally occur after sunrise and before sunset, the system may drive the backlight to produce different brightness levels for each time. Thus, as used herein, the terms "nighttime level" and "daytime level" may represent brightness level values that are based on a specific time of day, and a brightness level for a given time of day may be obtained from a lookup table or through an equation/calculation. In this manner, given the assumption that there will be more ambient light present during the afternoon than in the early morning (or late evening for that matter), a system might drive a display at a brightness level that is higher at 1:30 p.m. than at 9:15 a.m., despite the fact that both times occur during the daytime.

It should also be noted that the transition from a "nighttime" brightness level to "daytime" brightness level preferably does not occur in a drastic manner, where an abrupt change or flicker in the display might be observed by a viewer. Rather, it is preferable that such a change in display brightness level occurs in an incremental or ramped fashion, where the brightness level does not suddenly shift to a new value, but instead gradually changes to a new value over some period of time that would make the change less noticeable to a viewer.

Figure 4:
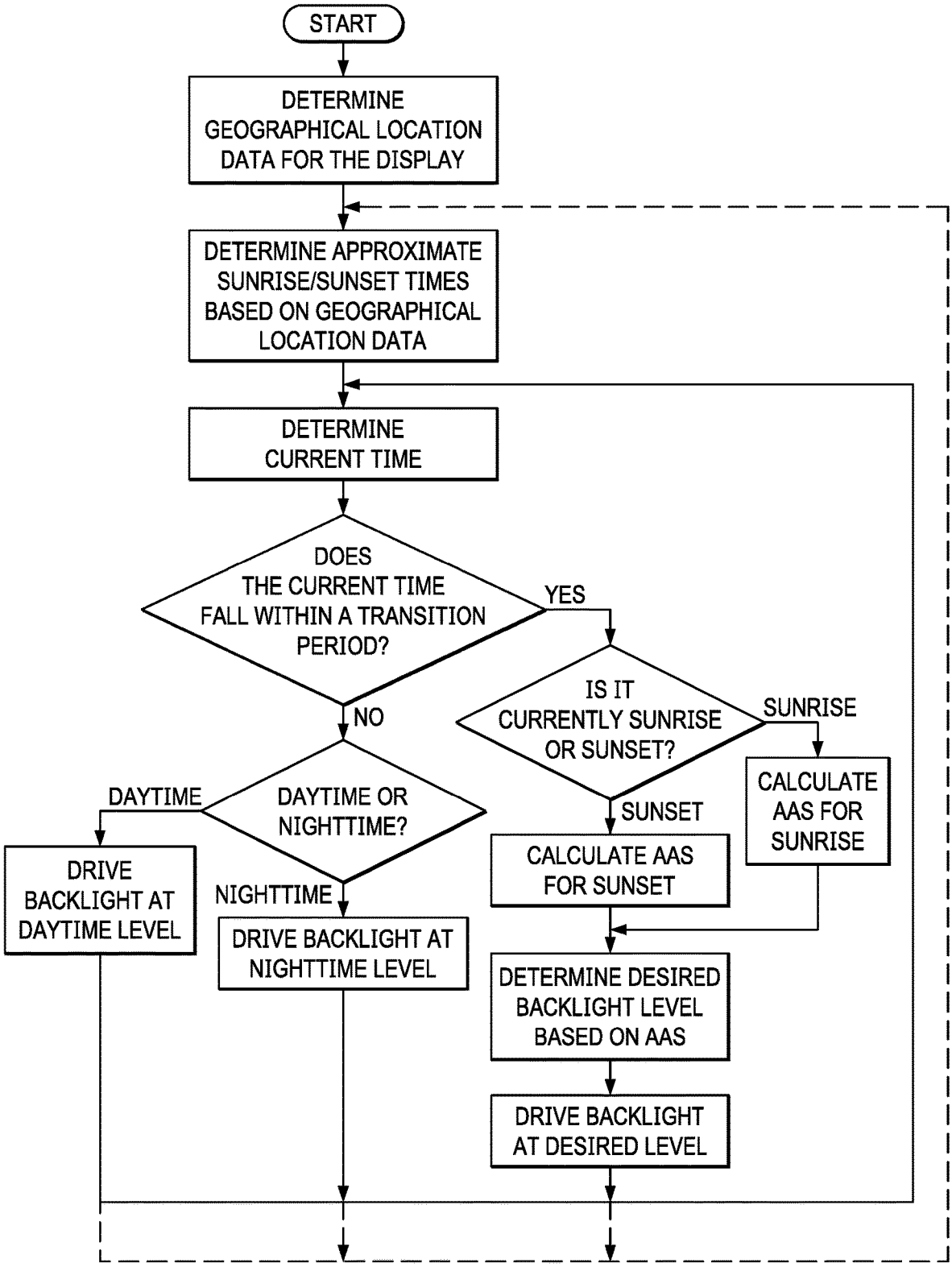
FIG. 4 is a logic flow chart for an exemplary method of controlling electronic display brightness using an Artificial Ambient light Sensor (AAS) technique during sunset/sunrise transition times, and using a nighttime/daytime level for the other times.

An exemplary alternative method of controlling electronic display brightness using an Artificial Ambient light Sensor (AAS) technique during sunset/sunrise transition times and a nighttime/daytime level for other times is represented by the logic flow chart of FIG. 4. In one version of such an embodiment, generating AAS data involves defining the following parameters:

(1) Desired Nighttime Level—the desired display brightness at nighttime;

(2) Desired Daytime Level—the desired display brightness during the daytime;

(3) High Ambient Reading (HA)—the approximate raw data value corresponding to the highest ambient light levels for the display environment, which may be preprogrammed based on known data or assumptions about the approximate high ambient reading for the display environment;

(4) GPS coordinates for the display location or the address/city/state of the display location;

(5) Sunrise transition period ($t^{sr}$)—the amount of time (usually measured in seconds) to transition from nighttime to daytime; and (6) Sunset transition period ($t^{ss}$)—the amount of time (usually measured in seconds) to transition from daytime to nighttime.

For a method employing an AAS technique, the AAS data can be calculated during the sunrise transition period using the following equation:

$$\text{AAS for sunrise}=(t^{i}*\text{HA})/t^{sr} \quad (2)$$

where $t^{i}$ is the time in transition (i.e., $t^{i}$ varies between zero and $t^{sr}$).

Similarly, the AAS data for the sunset transition period can be calculated using the following equation:

$$\text{AAS for sunset}=\text{HA}-(t^{i}*\text{HA})/t^{ss} \quad (3)$$

where $t^{i}$ is the time in transition (i.e., $t^{i}$ varies between zero and $t^{ss}$).

Once the AAS data for either transition period has been calculated, the desired brightness level can be determined from any of the ambient light vs. display brightness relationships described above. In some embodiments, the sunset transition period and the sunrise transition period may be similar or substantially the same. In this case, it may not be necessary to have two transition periods. Instead, one transition period may be used.

Figure 5:
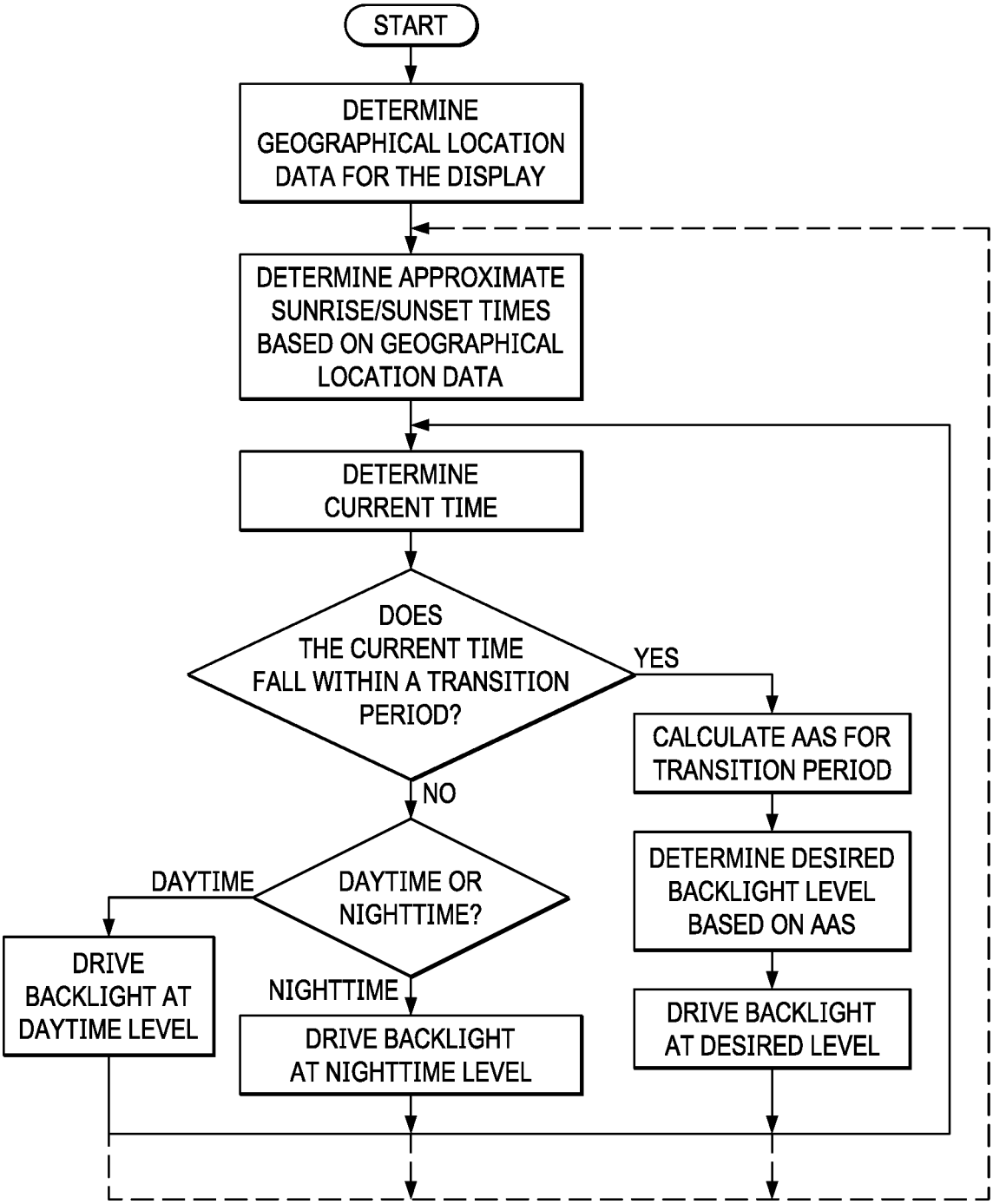
FIG. 5 is a logic flow chart for an exemplary method of controlling electronic display brightness using the AAS technique with only a single transition period, and using a nighttime/daytime level for the other times.

FIG. 5 is a logic flow chart representing an exemplary AAS-based method of controlling electronic display brightness that is similar to the technique represented in FIG. 4, but where only a single sunset/sunrise or sunrise/sunset transition period is used. As with the method of FIG. 4, a nighttime/daytime brightness level is used during other (non-transition) times.

In another exemplary embodiment, the system and method can also utilize local weather information to further tailor the display brightness. Such local weather information may be obtained from available web APIs or other online weather information which may be accessed at a predetermined time interval (e.g., every 15 minutes). In such an exemplary embodiment, a weather factor (WF) is calculated as:

$$\text{WF}=4*C^{i} \text{ (if it is daytime or any transition period)} \quad (4)$$

where $C^{i}$=clearness percentage with a higher percentage representing a clear sky and a lower percentage representing a large amount of cloud cover. The inverse could also be used, where a higher percentage represents more cloud cover and a lower percentage represents less cloud cover. Either technique would be well understood by a person of ordinary skill in the art.

In this exemplary embodiment, the AAS data can be calculated during the sunrise transition period according to the following equation:

$$\text{AAS for sunrise}=(t^{i}*(\text{HA}*\text{WF}))/t^{sr} \quad (5)$$

Similarly, the AAS for the sunset transition period can be calculated according to the following equation:

$$\text{AAS for sunset}=(\text{HA}*\text{WF})-(t^{i}*(\text{HA}*\text{WF}))/t^{ss} \quad (6)$$

If it is daytime, AAS=HA*WF.

If it is nighttime, AAS=0.

Once AAS for either transition period or the daytime has been calculated, the desired brightness level can be determined from any of the ambient light vs. display brightness relationships described above.

Figure 6:
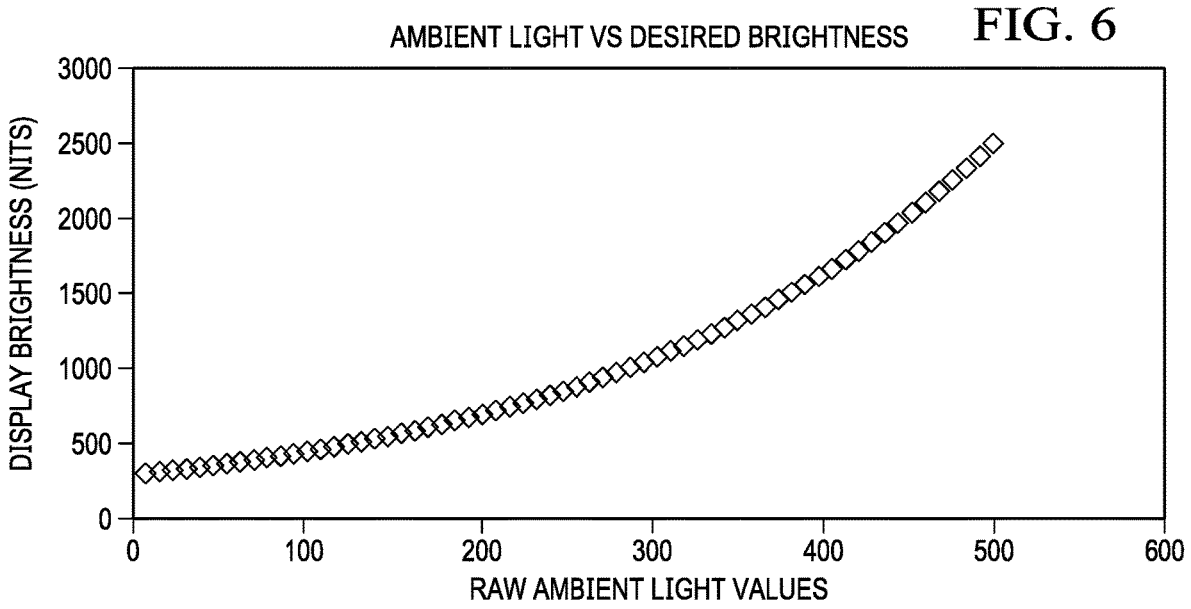
FIG. 6 is a graphical representation of a desired display brightness in response to raw ambient light values.

FIG. 6 graphically represents one example of desired electronic display brightness at different ambient light values. The chart of FIG. 6 is provided only as an example, and does not represent required brightness levels for any specific embodiment.

It has been found that the human eye is more sensitive to brightness variations in low ambient light environments than in high ambient light environments. Therefore, in some embodiments, a more aggressive display brightness level response may be desired at lower ambient light levels. In this regard, FIG. 7 graphically represents an embodiment where the display brightness level is higher at low ambient light levels than in the embodiment represented in FIG. 6. The brightness level curve data of FIG. 6 or FIG. 7, or of another curve, could be used to create a look-up table or in an equation to determine the desired display brightness for each ambient light situation.

Figure 7:
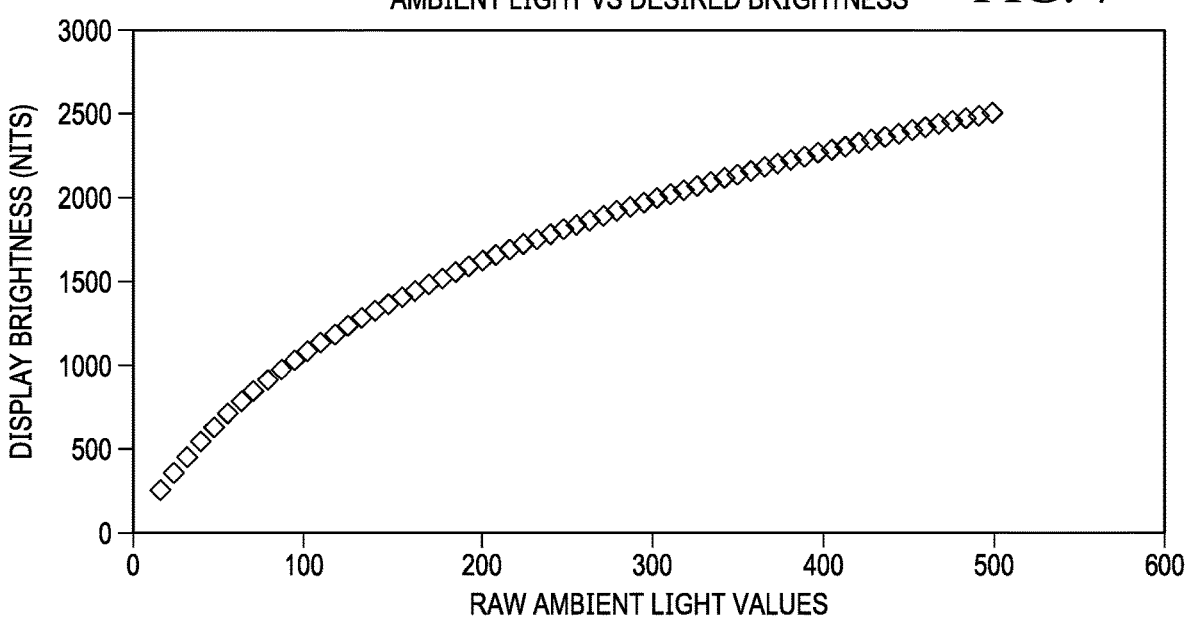
FIG. 7 is a graphical representation of a desired display brightness in response to raw ambient light values, where a low light ambient environment requires a higher display brightness level.

It should be noted that while the curves of FIGS. 6-7 are presented in terms of display brightness, the exemplary embodiments herein can be based on either display brightness or backlight brightness, depending on what type of electronic display is being used (i.e., whether a backlight is present) and the sensors used to measure the brightness level output (if such sensors are used). It should also be noted that while the values shown in FIGS. 6-7 are based on actual raw ambient light value data obtained from ambient light sensors, light data used in the calculations of the exemplary embodiments described herein need not be based on actual ambient light measurements. Rather, it should be understood from the foregoing description that the calculation of AAS values can be performed without actual ambient light measurements, and the calculated AAS values may be used in display brightness vs. ambient light value relationships like those shown in FIGS. 6-7. In other words, the display brightness vs. ambient light value relationship shown in FIGS. 6-7 does not require the use of actual ambient light sensor data, as such relationships may be used when working with AAS data as well.

Figure 8:
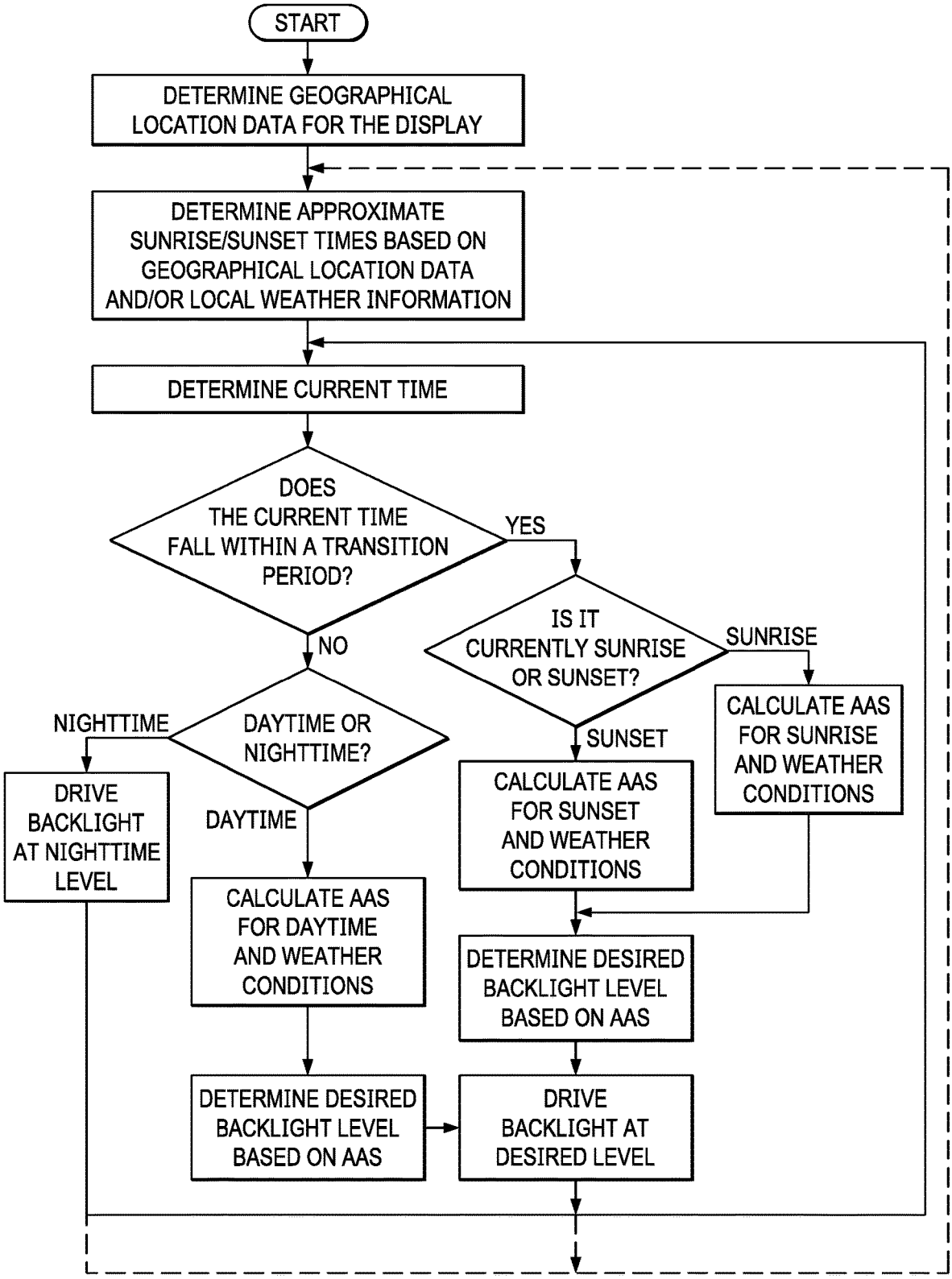
FIG. 8 is a logic flowchart for an exemplary method of controlling electronic display brightness using the AAS technique during sunset/sunrise transition times as well as the daytime, while also factoring in local weather information.

FIG. 8 is a logic flowchart for an exemplary method of controlling electronic display brightness using the AAS technique during sunset/sunrise transition times as well as the daytime, while also factoring in local weather information. In this exemplary embodiment, the local weather conditions can be determined by instructing the system (e.g., the system control board) to access the local weather information from an online resource. From this data, a clearness percentage may be calculated. The precise relationship between the local weather information and the clearness percentage is not critical, but generally a high clearness percentage would coincide with the local weather information indicating a clear day and a low clearness percentage would coincide with the local weather information indicating a cloudy day or one with precipitation.

As an example, during the daytime (i.e., not within either transition period or nighttime) and where the local weather information indicates that it is overcast and raining, relevant exemplary calculations might be:

$Ci$=10% clearness percentage

HA=500

Weather factor=4*0.10=0.40

AAS=500*0.40=300

Desired Display Brightness~=1040 nits (from FIG. 6 with an ambient light value of 300); or Desired Display Brightness~=1965 nits (from FIG. 7 with an ambient light value of 300).

Note that without correction for local weather conditions, the daytime value would likely be 500, which would mean the Desired Display Brightness~=2500 nits. Consequently, it can be clearly understood that this exemplary method of controlling electronic display brightness can significantly reduce the amount of electrical energy that will be used to power the display (or backlight) by accounting for the reduced ambient light level resulting from an overcast sky.

As another example of the same exemplary method of controlling electronic display brightness, if the electronic display is halfway through a sunrise or sunset transition, the calculated light sensor value and corresponding desired brightness might be:

$t^{sr}$=1800 seconds $t^{i}$=900 seconds

HA=500

Weather factor=4*0.10=0.40

AAS=(900*500*0.40)/1800=100

Desired Display Brightness~=465 nits (from FIG. 6 with an ambient light value of 100); or Desired Display Brightness~=1030 nits (from FIG. 7 with an ambient light value of 100).

Without correction for local conditions, the AAS value would likely be 250 which corresponds with a Desired Display Brightness~=850 nits.

Figure 9:
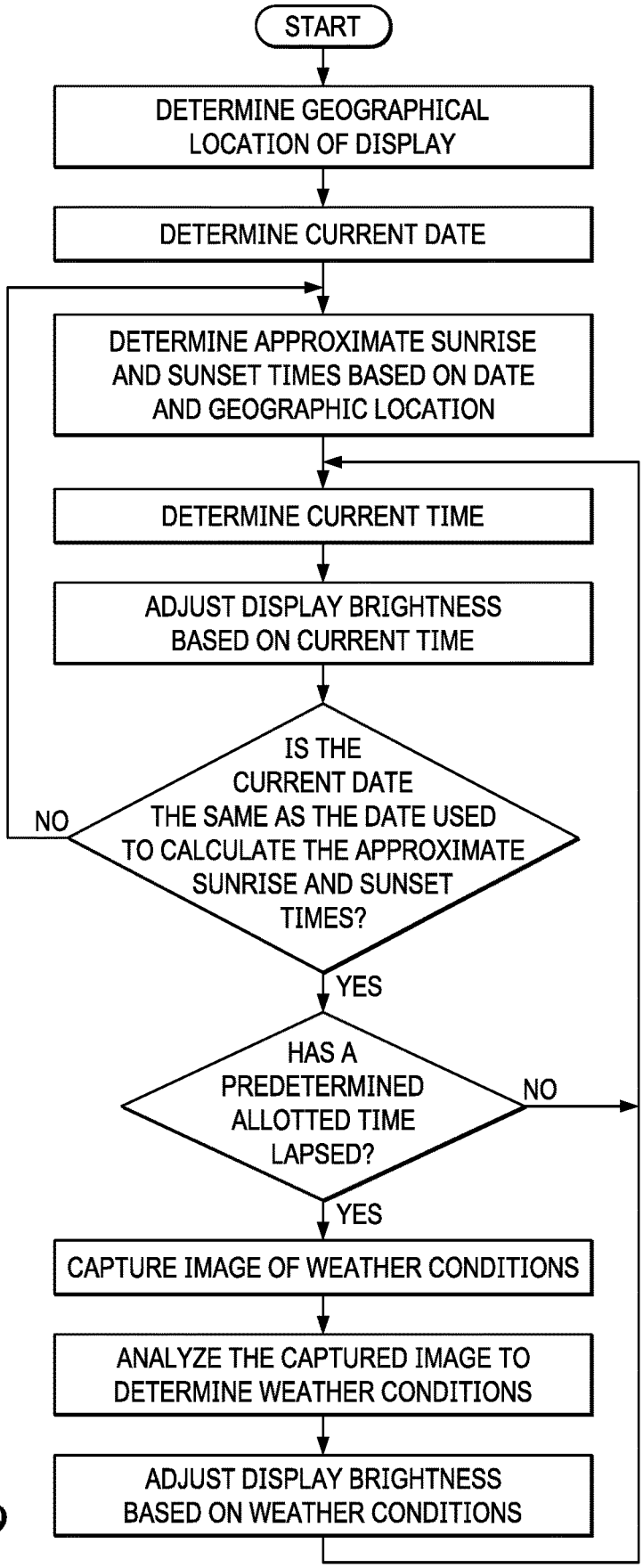
FIG. 9 is a logic flowchart for an exemplary method of controlling electronic display brightness by using an image capture device to detect ambient weather conditions and adjusting the display brightness level accordingly.

FIG. 9 is a logic flowchart for an exemplary method of controlling electronic display brightness by using an image capture device to detect ambient weather conditions and adjusting the display brightness level accordingly. Initially, the system may determine the geographic location and date. As previously described the system may use this information to determine the approximate sunrise and sunset times, and may or may not include a transition time.

In an exemplary embodiment employing the logic of FIG. 9, the system may determine the current date and time information by accessing a reliable source of the current date and time by API or the like. For example, without limitation, http://www.time.gov/. In other exemplary embodiments, the system may determine the current date and time information as kept by an internal clock and calendar.

The system may adjust the display brightness according to the current time as previously described. The system may check to ensure that the current date is the same as the date used in determining the approximate sunrise and sunset times as the sunrise and sunset times vary slightly on a daily basis. If the date has changed, the system may recalculate the approximate sunrise and sunset times. However, in other exemplary embodiments, the period between recalculating the approximate sunrise and sunset times may be any amount of time, such as days, weeks, months, or years.

If the date has not changed, the system may check to see if a predetermined allotted amount of time has passed. If not, then the system may return to checking the current date. If a predetermined allotted amount of time has passed, the system may capture an image and/or video of the current weather conditions. The image and/or video may be analyzed to determine the current weather conditions and the electronic display (or backlight) may be driven at an increased or decreased brightness level to adjust for the weather conditions as previously described. The system may then return to determining the current date and time.

Figures 10, 12:
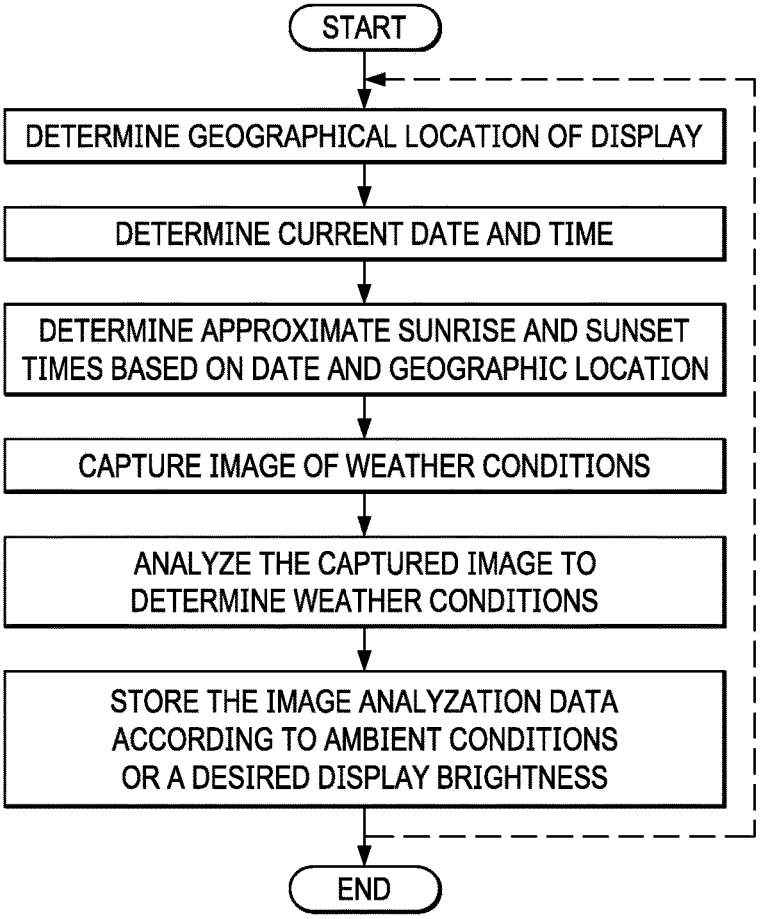
FIG. 10 is a logic flowchart illustrating various steps of performing an exemplary initial set up routine, which is preferably followed by an exemplary normal operation routine such as, but not limited to, that shown in FIG. 11.
FIG. 12 is a chart of exemplary sample data produced when performing the routine of FIG. 10, specifically by analyzing captured image and/or video data to determine ambient conditions and storing the image analysis data according to ambient conditions.
Figure 11:
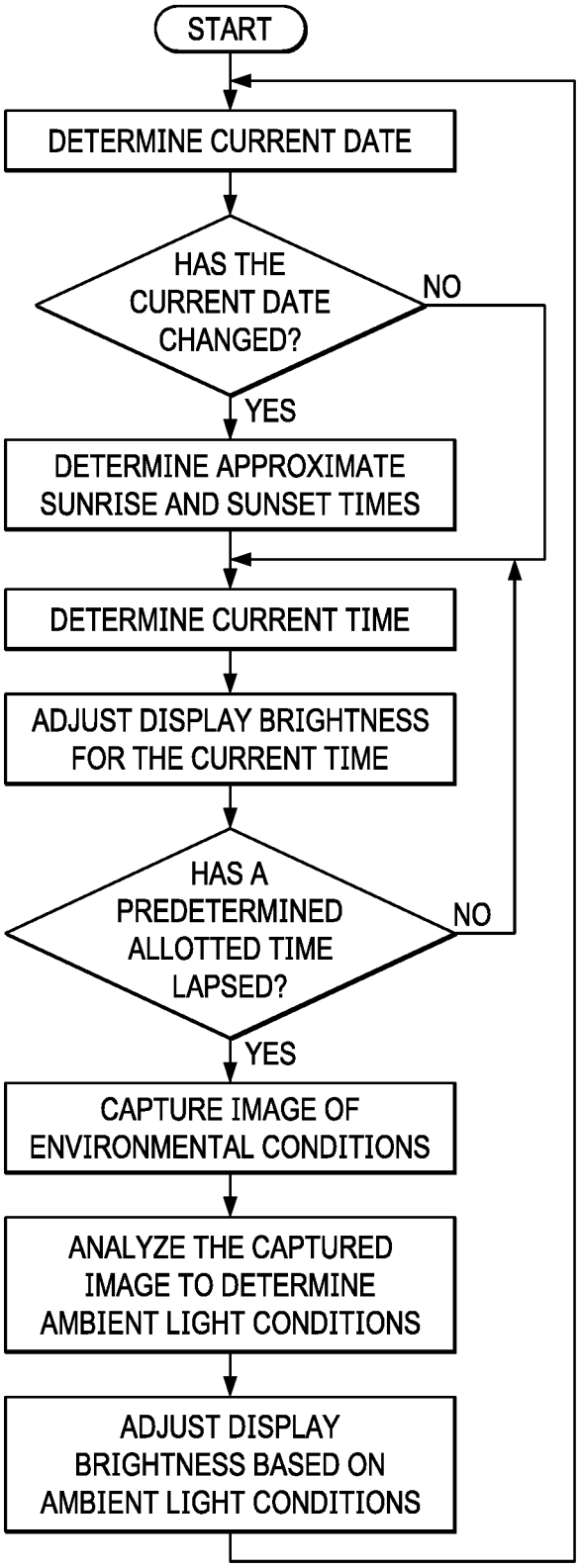
FIG. 11 is a logic flowchart illustrating various steps of performing an exemplary normal operation routine, which is preferably performed following an exemplary initial set up routine such as that exemplified in FIG. 10.

FIG. 10 is a logic flowchart illustrating various steps of performing an exemplary initial set up routine, which is preferably followed by an exemplary normal operation routine such as, but not limited to, that shown in FIG. 11. Upon installation, restart, recalibration, updating, reprogramming, or the like of the system, the initial set up routine may be performed automatically. Alternatively, the user may instruct the system to run the initial set up routine at any time. As indicated in FIG. 10, the initial set up routine may include determining the geographic location of the electronic display, determining current date and time information, determining the approximate sunrise and sunset times at the location of the display, capturing an image, analyzing the image to determine current weather conditions, and storing the image analysis data according to existing ambient conditions (or a desired display brightness) and optionally time of day. In other exemplary embodiments, this process may be repeated continuously to be performed as the normal operation routine as denoted by the dashed lines. This process can be running in the background of the system to constantly update the image analysis data that has been stored.

FIG. 11 is a logic flowchart illustrating various steps of performing an exemplary normal operation routine, which is preferably performed following an exemplary initial set up routine such as that exemplified in FIG. 10. According to the exemplary logic of FIG. 11, the system may determine the current date and check if the date has changed. If the date has changed, the system may determine approximate sunset and sunrise times. Regardless, the system may then determine the current time and adjust the display brightness according to the current time as compared to the approximate sunset and sunrise times as previously discussed. If a predetermined amount of allotted time has not lapsed, the system may continue to check the time and adjust the display as needed. If the predetermined amount of allotted time has passed, the system may capture an image or video of the weather conditions, analyze the image and/or video, and as previous discussed, adjust the display accordingly. The predetermined amount of allotted time may be any amount of time and may be changed by the user, but preferably is on the order of several minutes. Once the image or video is captured, analyzed, and the display is adjusted, the system may return to checking the date.

FIG. 12 is a chart of exemplary sample data produced when performing an initial setup routine, such as the routine of FIG. 10, specifically by capturing image and/or video data, analyzing said data to determine ambient conditions, and storing the image analysis data according to ambient conditions. As noted above, in exemplary embodiments, the processor 106 may be configured to identify weather conditions such as, but not limited to, rain, snow, hail, sleet, other precipitation, sunlight, cloud cover, cloud ceiling, fog, haze, large light-blocking objects, etc. In exemplary embodiments, this analysis may be completed by shape recognition, histogram analysis, motion detection, and other imaging processing and analysis techniques, software, and systems.

In the particular exemplary embodiment represented in FIG. 12, a histogram analysis has been performed on each image taken by the camera 102, to determine the relative "brightness" of the image. Here, an arbitrary brightness scale of 0 (very dark) to 1,000 (very bright) has been used, but other scales may be employed instead. The histogram data may be small or large numbers. The presented scale of 1-1,000 is provided only as an example, and said scale is not specifically required.

A table liken that depicted in FIG. 12 could be generated for every hour of every day, every minute of every day, every second of every day, or as shown here, just for several different times (or at different time intervals) during the day. A time-based table can be generated for each month (since the ambient light levels may not change extensively within a 30-day period) or a table may be generated for each day.

According to an exemplary embodiment that applies the logic of FIG. 11, once an image and/or video is captured, the histogram analysis can be performed to determine the image brightness, and then based on the time of day and the image brightness, the desired display brightness can be determined. From this data, the system may adjust the actual display brightness to correspond with the desired display brightness. An open loop or a traditional feedback loop, such as a loop using the light sensor 29 or 40 described above, may be used in this regard.

Figure 13:
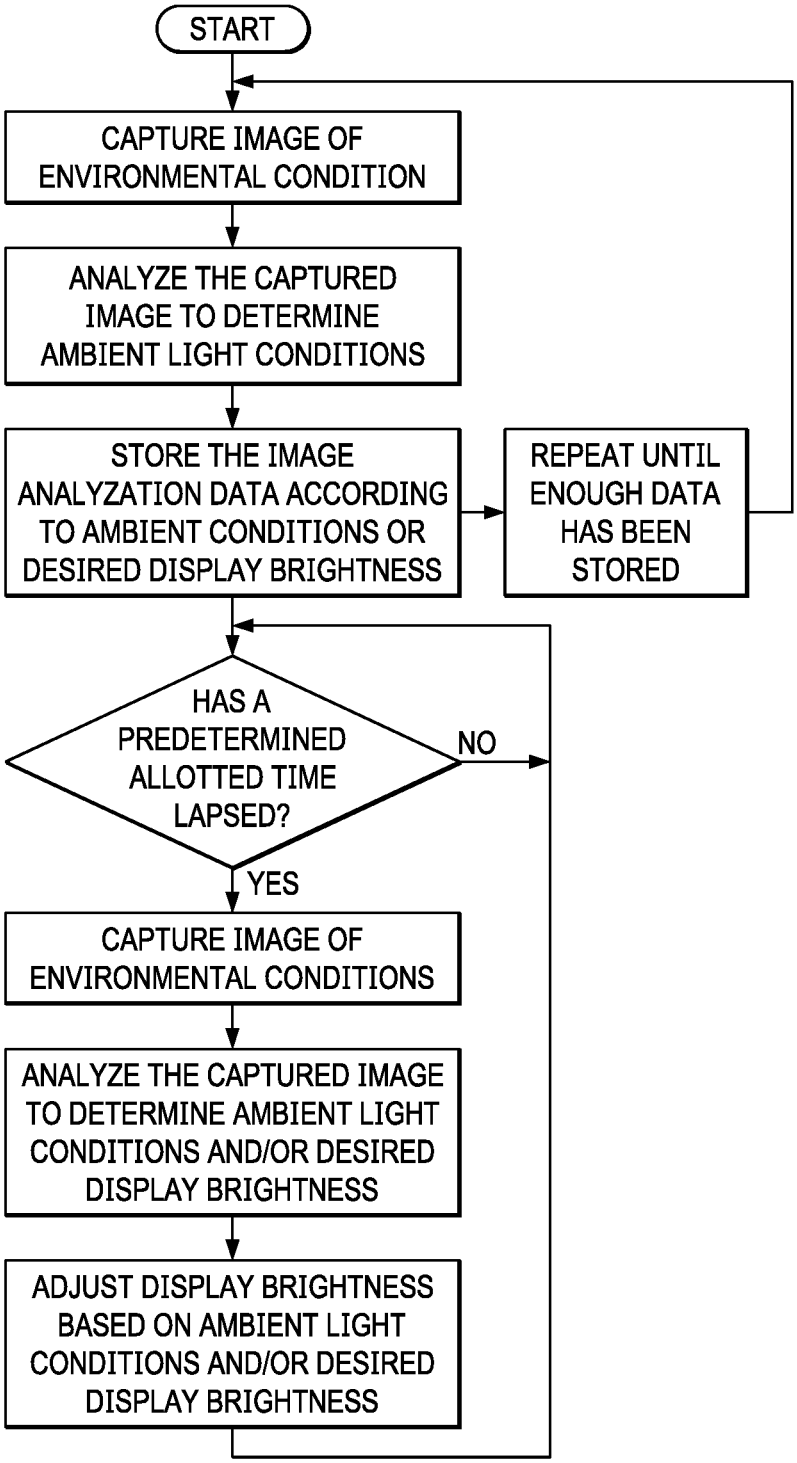
FIG. 13 is a logic flowchart for an exemplary method of controlling electronic display brightness where the geographical location and time of day is not used.

FIG. 13 is a logic flowchart for an exemplary method of controlling electronic display brightness where the geographical location and time of day is not used. This exemplary embodiment is shown to begin with a setup routine similar to that described and shown above in reference to FIG. 10. Following the setup routine, the system begins normal operations, which preferably includes waiting for a predetermined amount of time before capturing an image and/or video of the environmental conditions locally of the electronic display. The image and/or video is then analyzed according to the above-described techniques to determine the ambient lighting conditions or a desired display brightness level. If determining the ambient lighting conditions, the desired display brightness can be obtained from an ambient light conditions vs. display brightness relationship, such as the exemplary graphical relationship shown in FIGS. 6-7, or from any table or other relationship described above. If determining the desired display brightness level directly from the image and/or video data, relationships such as those shown and described above with respect to FIG. 12 may be used, as may any other similar method for analyzing the image and/or video data and setting a desired display brightness level in response.

Figures 14, 15:
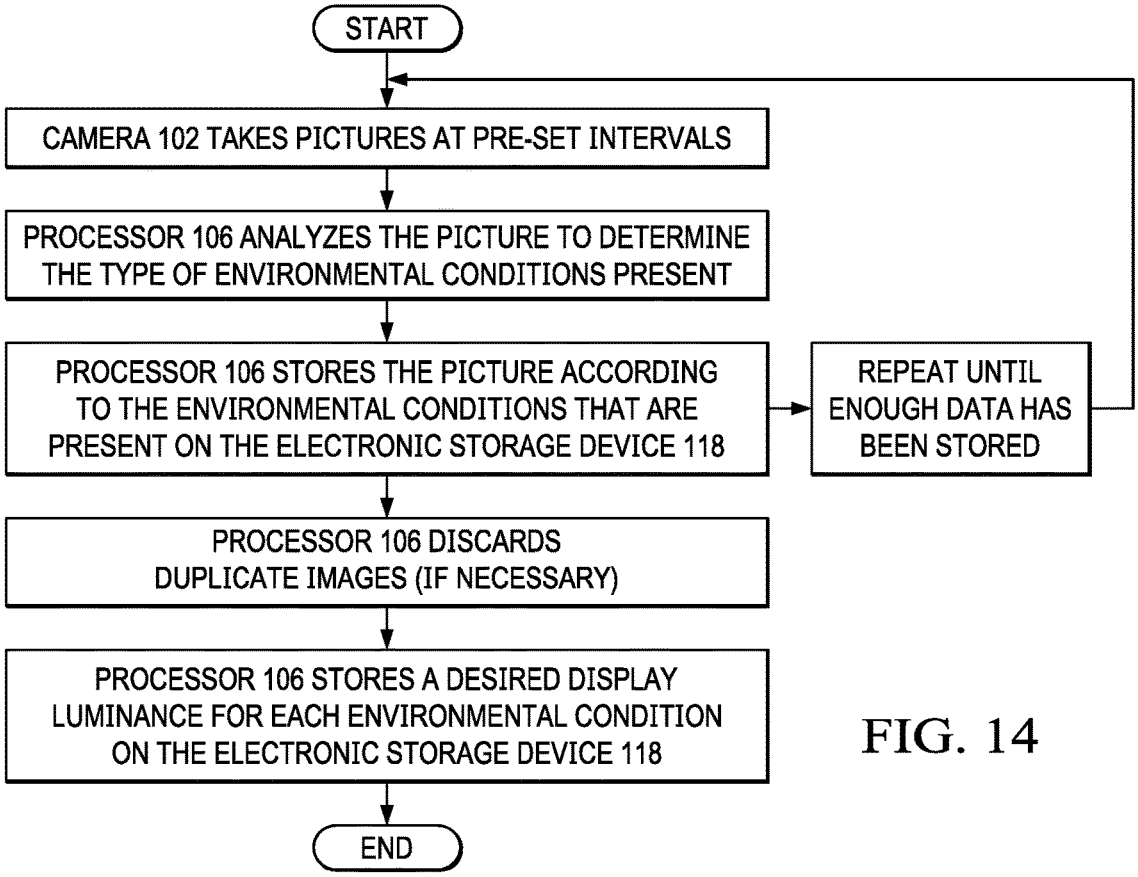
FIG. 14 is a logic flowchart illustrating various steps of performing an exemplary initial set up routine, where no sunrise/sunset times or geographical location data are necessary.
FIG. 15 represents an exemplary lookup table and/or database that may be produced and stored through the setup routine of FIG. 14.

FIG. 14 is a logic flowchart illustrating various steps of performing an exemplary initial set up routine, where no sunrise/sunset times or geographical location data are necessary. In such an exemplary embodiment, and referring back to FIG. 1, the camera 102 preferably captures an image and/or video at pre-set intervals (based on an internal clock within the processor 106). The processor 106 may subsequently analyze the image and/or video to determine the type of environmental conditions present. The processor 106 may then store the image and/or video data on the electronic storage device 118 according to the environmental conditions that are determined to be present. A desired display brightness level value is then preferably stored for each determined environmental condition. The desired display brightness level values may also be stored on the electronic storage device 118. The initial setup routine represented in FIG. 14 may run continuously for several days, weeks, or months after an associated electronic display is installed. Such a setup routine may also run for an initial period when the electronic display is first installed, and later run again to update the stored data to account for any changes in the environment surrounding the display. Images which are duplicative (as determined by the processor 106) may be discarded so that a standard set of base images is stored according to each determined environmental condition.

FIG. 15 represents an exemplary lookup table and/or database that may be produced and stored through operation of a setup routine, such as the setup routine embodied in FIG. 14. As shown in FIG. 15, there are a variety of environmental conditions that can be stored. The list of environmental conditions presented in FIG. 15 is by no means exhaustive, but merely provided as an example. One of skill in the art may take into account a greater or fewer number of environmental conditions, depending on the application.

As shown in FIG. 15, the desired display brightness level generally increases with an increase in the amount of light that is present in the ambient environment. While the display brightness levels shown in FIG. 15 are measured in nits, it should be understood that any accepted unit for measuring brightness may be used. Also, as noted above, the desired display brightness level may be the brightness within a backlight cavity when a backlight is present, or the brightness of the electronic display.

Figure 16:
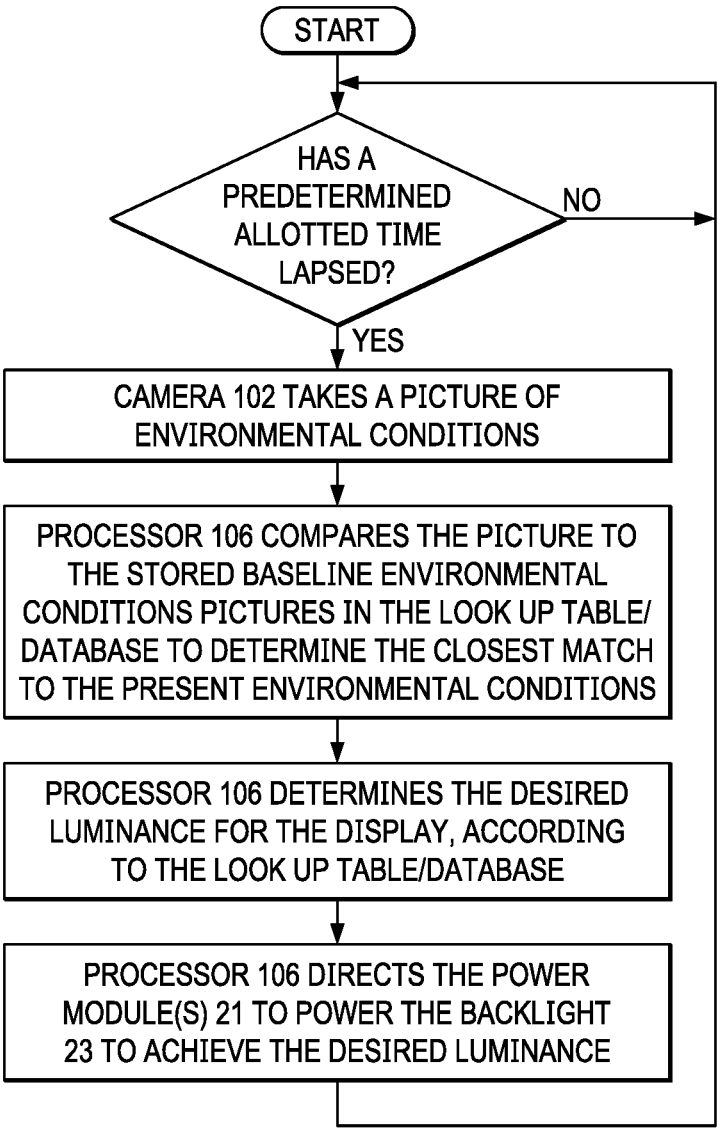
FIG. 16 is an exemplary logic flowchart for performing ongoing operations associated with an electronic display, according to the setup routine of FIG. 14 and the lookup table/database of FIG. 15.

FIG. 16 is an exemplary logic flowchart for performing ongoing operations associated with an electronic display, according to the setup routine of FIG. 14 and the lookup table/database of FIG. 15. Initially, once a predetermined amount of time has elapsed, the camera 102 captures an image and/or video of the environmental conditions local to the associated electronic display. The processor 106 may then compare this image and/or video to the stored baseline image and/or video of various environmental conditions created during the initial setup period, to determine which baseline image and/or video most closely resembles or matches the present image and/or video. The processor may then determine the desired display brightness, based on a look up table or database, such as is shown in FIG. 15. The processor 106 may then direct the power module(s) 21 to power the backlight 23 (or an electronic display when no backlight is present) to achieve the desired brightness level. As noted above, feedback loops can be setup with either the backlight sensor 29 or the sensor 40 to ensure that the desired display brightness is obtained/maintained.

Having shown and described various exemplary embodiments of the invention, those skilled in the art will realize that many variations and modifications may be made to affect the described embodiments while remaining within the scope of the inventive concept. Additionally, many of the elements described above may be altered or replaced by different elements which will provide the same result and fall within the spirit of the inventive concept. It is the intention, therefore, to limit the inventive concept only as indicated by the scope of the following claims.

What is claimed is:

1. A system for controlling brightness of an electronic display, the system comprising:

an image capture device in proximity to the electronic display and configured to capture images and/or video containing attributes of local environment;

a controller in communication with the image capture device and the electronic display, the controller configured to:

determine environmental conditions local to the electronic display by directly analyzing attributes of the local environment that appear in the images and/or video captured by the image capture device;

translate the local environment condition analysis into a weather factor number, where the weather factor number includes a constant value multiplied by a sky clearness percentage as determined from the analysis of the images/video captured by the image capture device; and adjust brightness level of the electronic display as necessary in response to the weather factor number.

2. The system of claim 1, wherein the controller is configured to increase the brightness level of the electronic display if the weather factor number indicates local environmental conditions that would typically result in dim ambient light conditions, and to decrease the brightness level of the electronic display if the weather factor number indicates local environmental conditions that would typically result in bright ambient light conditions.

3. The system of claim 1, wherein the controller includes a location detection device configured to determine geographic location of the electronic display and to communicate said location to the controller, and is further configured to determine a parameter selected from a group consisting of current date, current time, approximate sunrise and sunset times, and various combinations thereof.

4. The system of claim 1, wherein the electronic display is of a type selected from a group consisting of a liquid crystal display with a backlight, a plasma display, a light-emitting polymer display, and an organic light emitting diode display.

5. The system of claim 1, further comprising a lookup table/database of different environmental conditions and corresponding desired electronic display brightness levels, the lookup table/database accessible by the controller.

6. The system of claim 1, wherein the attributes of the local environment are selected from a group consisting of rain, snow, hail, sleet, other types of precipitation, fog, haze, cloud cover, cloud ceiling, presence of large light blocking objects, and combinations thereof.

7. The system of claim 1, wherein the controller is configured, during a device setup procedure, to instruct the image capture device to periodically capture images of the environmental conditions local to the electronic display and to populate a database with said images.

8. The system of claim 1, further comprising a display light sensor for detecting the brightness level of the electronic display, the display light sensor in communication with the controller.

9. The system of claim 1, further comprising a backlight light sensor for detecting the brightness level of a backlight associated with the electronic display, the backlight light sensor in communication with the controller.

10. The system of claim 1, wherein the controller is configured to directly analyze the attributes that appear in the images/video captured by the image capture device using a technique selected from a group consisting of shape recognition, histogram analysis, motion detection, and combinations thereof.

* * * * *